US005573446A

United States Patent [19]

Dey et al.

[11] Patent Number: 5,573,446

[45] Date of Patent: Nov. 12, 1996

[54] ABRASIVE AIR SPRAY SHAPING OF OPTICAL SURFACES

[75] Inventors: Thomas W. Dey, Springwater; Matthew F. Walsh, Rochester, both of N.Y.

[73] Assignee: Eastman Kodak Company, Rochester, N.Y.

[21] Appl. No.: 390,397

[22] Filed: Feb. 16, 1995

[51] Int. Cl.[6] ..... B24B 1/00; B24C 1/00

[52] U.S. Cl. ..... 451/39; 451/42; 451/38

[58] Field of Search ..... 29/90.01; 134/7, 134/32; 451/38, 39, 41, 42, 43, 44, 60

[56] References Cited

U.S. PATENT DOCUMENTS

| | | | |
|---|---|---|---|
| 1,566,127 | 12/1925 | Rundquist | 451/42 X |
| 1,588,768 | 6/1926 | Moulton | 451/42 X |
| 3,085,368 | 4/1963 | Oostland | 451/38 X |
| 3,328,925 | 7/1967 | Hewitt | 451/38 X |
| 3,339,318 | 9/1967 | Graf et al. | 451/42 |
| 3,578,850 | 5/1971 | Grant | 451/39 X |
| 3,848,365 | 11/1974 | Bovensiepen | 451/28 |
| 4,669,229 | 6/1987 | Ehlbeck | 451/39 |
| 4,787,178 | 11/1988 | Morgan et al. | 451/38 X |
| 4,958,463 | 9/1990 | Hess et al. | 451/178 |

*Primary Examiner*—Timothy V. Eley
*Attorney, Agent, or Firm*—Thomas H. Close

[57] ABSTRACT

A method of shaping surface on an optical element includes directing a stream of gas and particles at the surface at a velocity sufficient to controllably remove material from the surface to figure the surface to a desired optical profile.

10 Claims, 2 Drawing Sheets

ABRASIVE AIR SPRAY SHAPING OF OPTICAL SURFACES

FIELD OF THE INVENTION

The invention relates generally to the shaping of an optical surface and more specifically to shaping a glass surface with an abrasive.

BACKGROUND OF THE INVENTION

The precision grinding and polishing of hard materials, such as optical glass, typically includes several steps that progressively improve surface characteristics, particularly the figure or curvature of the surface. Starting from a blank that approximates the desired shape, material might be removed first by cutting, then by grinding and finally by lapping. Cutting typically is used to establish an approximate profile, while grinding refines the shape and lapping establishes the final figure and finish. Each stage removes less material but does so more precisely. Equally important, each stage removes stresses and damage to the surface from prior operations.

Precision grinding typically moves a rotary abrasive against the surface in minute increments. A massive support structure is used for rigidity, and a fine advancing mechanism for precision. The abrasive locally fractures and removes material, but must be controlled to prevent damage from excessive heat or pressure.

High velocity jets including suspended abrasives have been used for removing one material from the surface of a different material (e.g. cleaning and sandblasting), and for precision cutting of glass and other hard materials (e.g. waterjet cutting). In cleaning and sandblasting applications, nozzles are provided primarily for aiming the particle stream rather imprecisely in the desired direction for the purpose of removing surface contamination such as rust and paint. In precision cutting operations, on the other hand, the nozzle is aimed more precisely and its location is controlled for movement relative to the work surface accurately to cut the desired contour. The objective in cutting normally is to make sure the stream passes entirely through the work.

Prior art grinding and polishing techniques must be limited in speed to prevent internal stress build up and other damage, particularly when applied to large optics for observatories, and the like, that require perfection measured in the wavelengths of light. The speed of the abrasive relative to the work surface is limited by the mass of the abrasive tool or lap that supports the abrasive and applies it to the surface.

Previous approaches also suffer from the relatively unyielding pressure between the abrasive and the work surface. High spots can result in substantial forces and heat generation, certainly against a hard abrasive, but also against the softer materials employed in a lap. Internal stresses from the resulting heat and strain have long term deleterious effects. Previous approaches also suffer from the stringent requirement to rigidly support the workpiece being shaped, without significantly distorting it. This necessitates strain free holding fixtures which workpiece during the grinding and polishing process. If the holding fixture is not strain free, the shaped surface may "spring" when the workpiece is removed from the holding fixture, resulting in a misshapen surface. Furthermore, the holding fixtures of the prior art need to tightly constrain the position of the workpiece against lateral forces generated by the grinding and polishing steps, since even slight shifting of the workpiece during grinding or polishing will result in a misshapen surface.

SUMMARY OF THE INVENTION

The present invention is directed to overcoming one or more of the problems set forth above, and to improving existing processes and apparatus for shaping optical surfaces such as optical glass. Briefly summarized, according to one aspect of the invention, a method and apparatus are provided for shaping a hard surface by directing a high-velocity stream of gas and particles through a nozzle exit to impinge with sufficient force upon the surface to remove material from the surface.

According to a preferred embodiment of the invention, the abrasive gas mixture comprises #60 garnet in air, and the stream is scanned transversely to the optical surface, in order to achieve controlled global shaping of a large surface using a relatively small (1 to 10% of the diameter of the workpiece), controlled jet.

These and other aspects, objects, features and advantages of the present invention will be more clearly understood and appreciated from a review of the following detailed description of the preferred embodiments and appended claims, and by reference to the accompanying drawings.

ADVANTAGEOUS EFFECTS OF THE INVENTION

The shaping method of the present invention relieves the necessity for providing a strain free support for the workpiece because the rate of removal of material from the surface of the workpiece is relatively insensitive to the distance from the surface of the workpiece to the nozzle. Hence, if the workpiece sags under gravity, the sag will not appreciably affect the final surface figure of the workpiece. Additionally, since the method of the present invention does not result in lateral forces on the workpiece, the need for a holding fixture for tightly constraining the workpiece against lateral force is also relieved.

The shaping method of the present invention permits increased speeds without the deleterious effects of prior art methods. The abrasive gas spray is capable of removing material at very high rates, without damaging the workpiece being shaped. The use-of air as the carrying medium is an important element in the present invention since the momentum and kinetic energy of the abrasive gas mixture is carried predominantly by the abrasive itself. If a liquid were to be used as the carrying medium, a momentary loss of abrasive could result in damage to the workpiece due to momentum transfer to the workpiece by the liquid.

DETAILED DESCRIPTION OF THE INVENTION

Figure 1:
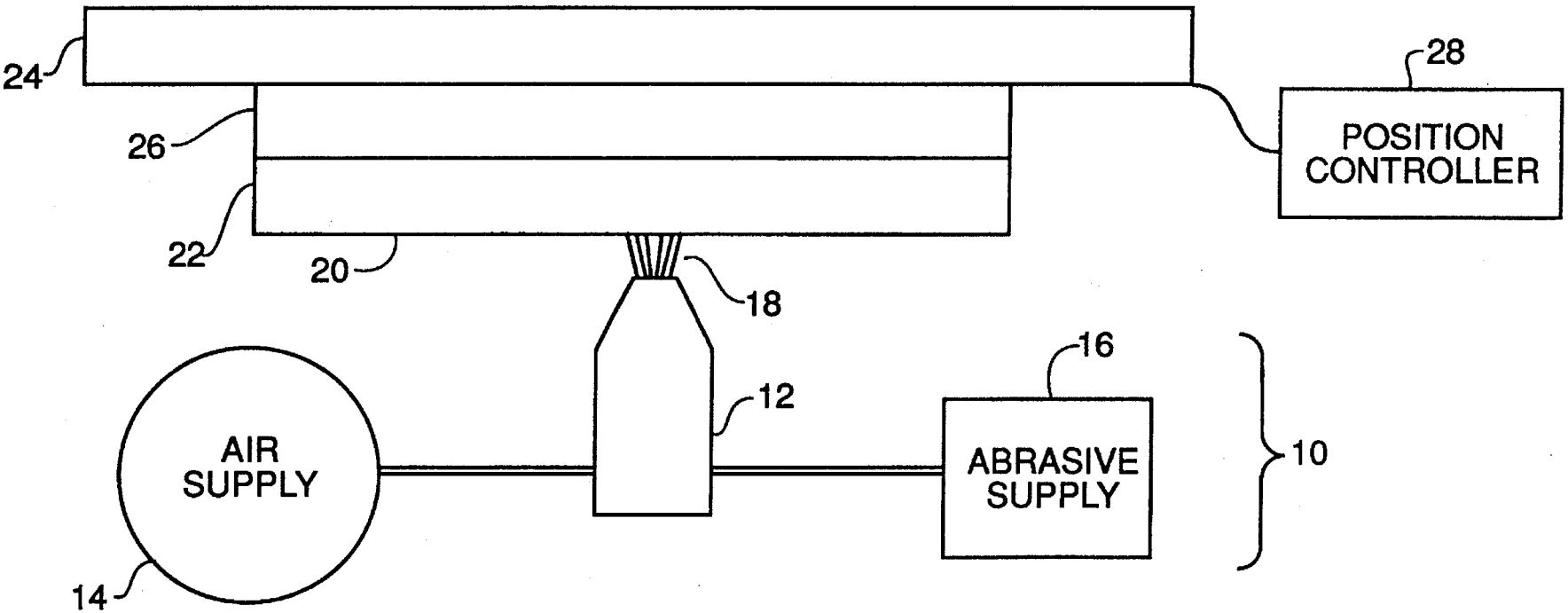
FIG. 1 is a schematic view of optical shaping apparatus in accordance with the invention.

Referring now to FIG. 1, apparatus for shaping an optical surface according to the present invention is shown. An abrasive jet blasting apparatus, generally designated 10, includes a nozzle 12 which is supplied with pressurized air from an air supply 14 and abrasive particles from an abrasive supply 16. An air/abrasive jet 18 from abrasive jet nozzle 12 is directed substantially perpendicular to the surface 20 of a workpiece 22. The workpiece 22 is moved relative to the abrasive jet 18 by X-Y tables 24 and 26 respectively, controlled by a position controller 28. As shown, the workpiece 22 is hung upside down. Ordinarily this method of supporting the workpiece would not be desirable due to sag of the workpiece due to gravity, and subsequent "springing" of the workpiece when released from the holding fixture. In the present invention, the rate of material removal from the surface of the workpiece is relatively insensitive to the displacement of the nozzle 12 from the surface of the workpiece, and as a result, the sag of the workpiece due to gravity does not affect the final shape of the workpiece.

The abrasive jet blasting apparatus 10 may comprise commercially available sandblasting equipment such as Dayton Model 3Z849 available from Dayton Manufacturing Col, Chicago, Ill. 60648, equipped with a model T1092 gun available from Trumans Inc., Canfield, Ohio. The X-Y work table and controller may comprise any CNC controlled X-Y table of the type known in the prior art.

The abrasive is preferably #60 garnet available from Barton Mines Corp, North Creek, N.Y. Alternatively the abrasive may be 10 to 500 μm glass beads available from Lukens Co., St. Louis, Mo. The air pressure and abrasive flow rate are adjusted in the blasting equipment to produce a desired rate or surface removal.

Figure 2:
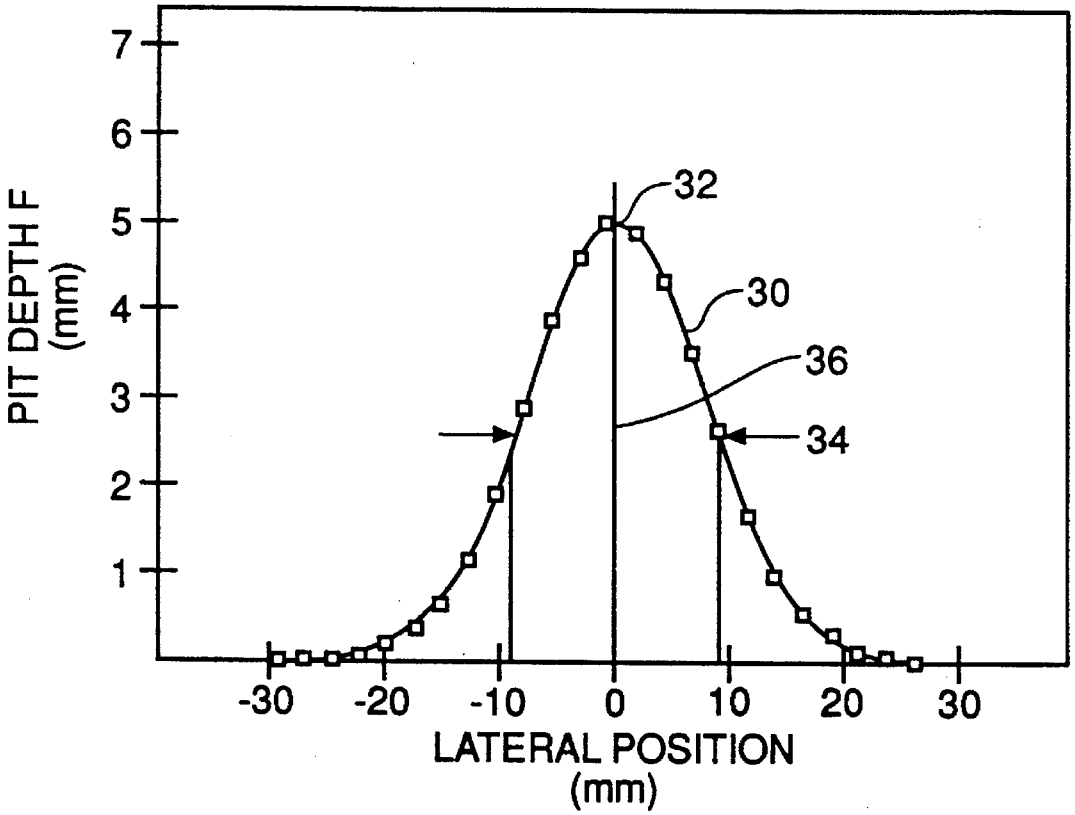
FIG. 2 is a graph showing a measured pit cross section illustrating the Gaussian surface shaping profile generated by the abrasive jet in an optical shaping apparatus according to the present invention.

In preparation for operation, the apparatus is set up as shown in FIG. 1 with a sample workpiece of the same material that is to be shaped, and operated with the nozzle stationary for a series of specified dwell times, moving the nozzle between each operation, to cut a series of pits of increasing depth. A number of pits are made at each dwell time. FIG. 2 graphically illustrates an actually measured cross sectional topology of one such pit. In this graphical representation, the abscissa is a measure of the lateral position from the pit center. The ordinate is the pit depth. As shown in FIG. 2, the pit will have a Gaussian profile 30. The maximum depth 32 and the width 34 at half the maximum depth of each pit is measured with a coordinate measuring machine, for example the Model 30000 Sheffield Codax measuring machine, purchased from the Sheffield Corp., Dayton, Ohio. As shown in FIG. 2, the Gaussian profile is symmetric in X and Y about an axis 36.

The depth of the pits at each dwell time are then averaged to produce an average pit depth for each dwell time. Because the profile of the pit is Gaussian the width at half maximum is the same independent of dwell time. All the widths at half maximum are averaged to produce an average width. The average depths at each dwell time and the average width determine a Gaussian material removal function F(x,y) characteristic of the particular apparatus set up and workpiece material.

The material removal function F(x,y) is input into the controller 28 of the X-Y tables 24 and 26. We have achieved removal rates of 50 $mm^3$/sec from white optical crown glass, without adversely heating or stressing the workpiece.

Figure 3:
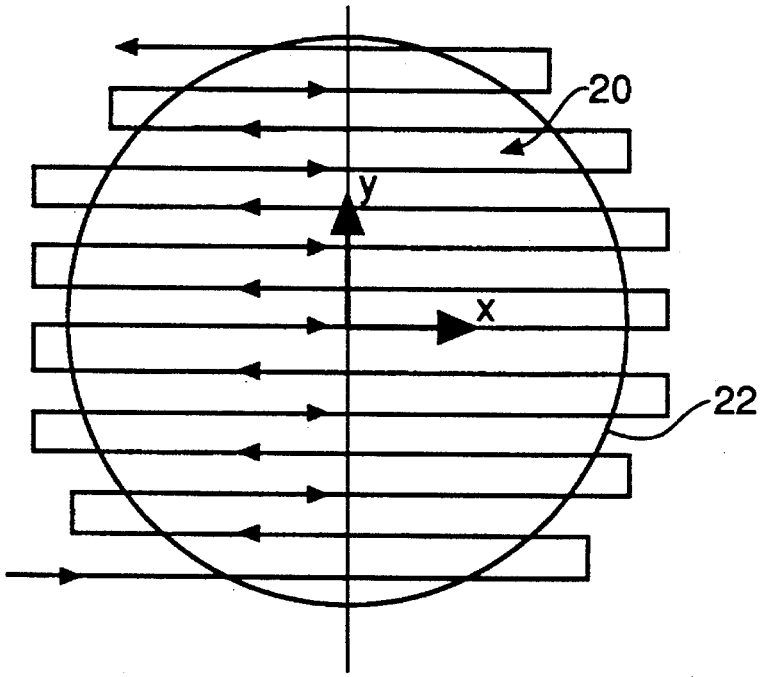
FIG. 3 is a schematic diagram showing a preferred scanning path of the jet nozzle of the optical shaping apparatus of FIG. 1 across an optical surface.

During operation of the apparatus shown in FIG. 1, the controller 28 moves workpiece 22 relative to the nozzle 12 in a raster pattern 32 as shown in FIG. 3. The relative velocity of the workpiece 22 and the nozzle 12 is controlled by the controller 28 to produce the desired shape of the surface 20 of workpiece 22. The spacing between passes of the nozzle 12 in the raster pattern 32 is kept constant and is typically one third of the width of the Gaussian material removal profile.

The dwell time $T_k$ of the nozzle 12 at a position x,y with respect to the workpiece 22 for forming a desired surface shape S(x,y), such as on asphere, from the original surface shape S'(x,y) is determined as follows. Given a desired removal function Z(x,y)=S'(x,y)−S(x,y) and a constant removal rate function F(x,y), a dwell function T can be determined from the following equation:

$$Z(x,y) = \sum_{k=1}^{n} F(x - x_k, y - y_k)T_k,$$

where the tool path has been divided into N discrete points $(x_k,y_k)$, and where $T_k$ is the dwell time at point $(x_k,y_k)$. This equation is solved for $T_1$, $T_2$, $T_A$ so as to give a best fit to Z(x,y) subject to the constraints $T_k>0$.

The controller 28 controls the position and velocity of the nozzle 12 with respect to the workpiece 22 according to the function Z(x,y) described above.

After a surface has been shaped according to the method described above, the surface shape can be measured and a subsequent error correcting operation can be performed on the apparatus. When this process is repeated a number of times, the ultimate accuracy of the surface has been found to be limited only by the ability to measure the error in the surface profile.

When a surface having the desired shape has been achieved, the surface can be polished using known optical polishing techniques such as small tool polishing or full lap polishing which will then yield a specular surface.

Although the preferred embodiment was described as the X-Y table 24, 26 moving the workpiece it will be apparent to one of skill in the art that the X-Y table could move the abrasive blasting apparatus relative to a fixed workpiece. Furthermore, although a rectangular raster pattern was described, a spiral or other pattern could be used.

The invention has been described with reference to a preferred embodiment. However, it will be appreciated that variations and modifications can be effected by a person of ordinary skill in the art without departing from the scope of the invention. For example, although the workpiece was described as glass, optical elements of light metals such as aluminum or beryllium may be figured according to the present invention.

PARTS LIST

10 abrasive jet blasting apparatus
12 nozzle
14 air supply
16 abrasive supply
18 air/abrasive jet
20 surface of workpiece
22 workpiece
24 X-table
26 Y-table
28 position controller
30 Gaussian profile
32 maximum depth
34 width
36 axis

We claim:

1. A method of shaping an optical surface an optical element, comprising directing a stream of gas and particles in a scanning path on the surface at a velocity sufficient to controllably remove material from the surface to shape the surface to the desired curvature.

2. The method claimed in claim 1, wherein the gas is air and the particles are #60 garnet abrasive particles.

3. The method claimed in claim 1, wherein the optical profile is an asphere.

4. The method claimed in claim 1, wherein the optical element is glass.

5. The method claimed in claim 1, wherein the gas is air and the particles are 10 to 500 μm glass beads.

6. The method claimed in claim 1, wherein the removal profile resulting from the method is Gaussian.

7. The method claimed in claim 1, wherein the stream is directed with a nozzle and further comprising the step of scanning the optical element relative to the nozzle in a raster pattern.

8. The method claimed in claim 7, wherein the stream is directed substantially perpendicular to the surface of the optical element.

9. The method claimed in claim 8, wherein the optical element is suspended upside down over the nozzle.

10. The method claimed in claim 1, wherein the stream has a diameter equal to between 1 and 10% of a diameter of the optical element.

* * * * *